US009214270B2

(12) United States Patent
Watanabe et al.

(10) Patent No.: US 9,214,270 B2
(45) Date of Patent: Dec. 15, 2015

(54) ELECTRONIC COMPONENT AND MANUFACTURING METHOD THEREOF

(71) Applicant: TDK Corporation, Tokyo (JP)

(72) Inventors: Fumio Watanabe, Tokyo (JP); Naozumi Ishikawa, Tokyo (JP); Hiroshi Kamiyama, Tokyo (JP)

(73) Assignee: TDK CORPORATION, Tokyo (JP)

( * ) Notice: Subject to any disclaimer, the term of this patent is extended or adjusted under 35 U.S.C. 154(b) by 33 days.

(21) Appl. No.: 14/198,857

(22) Filed: Mar. 6, 2014

(65) Prior Publication Data

US 2014/0266547 A1 Sep. 18, 2014

(30) Foreign Application Priority Data

Mar. 14, 2013 (JP) ..... 2013-052215

(51) Int. Cl.

| | |
|---|---|
| ***H01F 5/00*** | (2006.01) |
| ***H01F 27/28*** | (2006.01) |
| ***H01F 17/00*** | (2006.01) |
| ***H01F 27/29*** | (2006.01) |
| ***H01F 41/04*** | (2006.01) |

(52) U.S. Cl.

CPC ..... *H01F 17/0013* (2013.01); *H01F 27/29* (2013.01); *H01F 41/042* (2013.01); *H01F 2017/0066* (2013.01); *H01F 2017/0093* (2013.01); *Y10T 29/4902* (2015.01)

(58) Field of Classification Search

CPC ..... H01F 5/00; H01F 27/28
USPC ..... 336/200, 232
See application file for complete search history.

(56) References Cited

U.S. PATENT DOCUMENTS

| | | | | |
|---|---|---|---|---|
| 2007/0296536 | A1* | 12/2007 | Odahara et al. | 336/200 |
| 2009/0115563 | A1 | 5/2009 | Arata et al. | |
| 2011/0002075 | A1* | 1/2011 | Asakawa et al. | 361/111 |

FOREIGN PATENT DOCUMENTS

| | | | |
|---|---|---|---|
| JP | 05-001206 | H | 1/1993 |
| JP | 05-343262 | H | 12/1993 |
| JP | 10-172831 | | 6/1998 |
| JP | 2000-286125 | | 10/2000 |
| JP | 2003-338411 | | 11/2003 |
| JP | 2011-014747 | | 1/2011 |

(Continued)

OTHER PUBLICATIONS

JPO Office Action of Sep. 2, 2014 in related JP application 2013-052215, with English translation.

(Continued)

*Primary Examiner* — Tsz Chan
(74) *Attorney, Agent, or Firm* — Young Law Firm, P.C.

(57) ABSTRACT

An electronic component includes a first conductor layer including a first conductor pattern P1, a first insulating layer covering the first conductor layer, a first opening h1 passing through the first insulting layer to expose top and side surfaces of the first conductor pattern P1 therethrough, and a second conductor layer formed on the first insulating layer and including a second conductor pattern P2 connected to the first conductor pattern P1 through the first opening h1. A first opening region which is a planar region inside the first opening h1 includes a first region in which the first conductor pattern P1 is formed and a second region in which the first conductor pattern P1 is not formed. The second conductor pattern P2 is embedded in both the first and second regions of the first opening h1.

9 Claims, 12 Drawing Sheets

(56) References Cited

FOREIGN PATENT DOCUMENTS

| | | |
|---|---|---|
| JP | 2011029575 | 2/2011 |
| KR | 20090047377 | 5/2009 |

OTHER PUBLICATIONS

Korean Intellectual Property Office Action of Feb. 3, 2015 in related KR application KR20140025635.

* cited by examiner

ELECTRONIC COMPONENT AND MANUFACTURING METHOD THEREOF

BACKGROUND OF THE INVENTION

1. Field of the Invention

The present invention relates to an electronic component and a manufacturing method thereof and, more particularly, to a coil component such as a common mode filter and a manufacturing method thereof.

2. Description of Related Art

A common mode filter, which is known as one of electronic components, is widely used as a noise suppression component for a differential transmission line. Recent progress of manufacturing technology allows the common mode filter to be realized as a very small surface mount chip component (see, for example, Japanese Patent Application Laid-open No. 2011-14747), and a coil pattern to be incorporated is significantly reduced in size and space. However, when a thickness of the coil pattern is excessively small, DC resistance increases. Thus, it is desired to increase the thickness of a planar coil pattern as much as possible so as to prevent the increase in the DC resistance.

In the common mode filter, on the same plane on which the planar coil pattern is formed, there is also formed another conductor pattern such as a contact hole conductor or an internal terminal electrode. When the coil pattern needs to be formed thick by plating, a plating condition is optimized according to the coil pattern. However, when the coil pattern and another conductor pattern are simultaneously formed under such a plating condition, plating on the another conductor pattern having a comparatively large area grows up excessively, disadvantageously resulting in a large variation in height between the conductor patterns in the same conductor layer.

Particularly, as shown in FIG. 12A, a conductor pattern 32 having a slightly larger width (area) than that of a coil pattern 31 tends to assume a shape in which a center portion of a top surface thereof bulges. Further, as shown in FIG. 12B, a conductor pattern 33 having a considerably larger width (area) than that of the coil pattern 31 tends to assume a shape in which a portion around an outer periphery of a top surface thereof bulges, while a center portion thereof sags.

As shown in FIGS. 12A and 12B, such a variation in thickness between the conductor patterns becomes more noticeable as the thickness of the coil pattern 31 becomes large and is further emphasized by lamination of layers. When the conductor layers each including the conductor patterns varying in height are laminated to achieve a multilayer structure, flatness of a top surface of a conductor pattern formed in a topmost layer is significantly deteriorated due to a cumulative variation in height, which may in turn cause a conductor pattern P2 in the topmost layer to be exposed from the top surface of the insulating layer to lead to an insulation failure.

Further, when the top surface of the conductor pattern serving as a base surface for forming an opening by exposure of an insulating layer covering the conductor patterns bulges or sags, irregular reflection is caused on the top surface to cause defocus in an exposure unit, which degrades pattern processing accuracy. For these reasons, it is preferable, and required, that all conductor patterns formed within a conductor layer each have substantially the same height as the coil pattern and top surfaces thereof are flat.

SUMMARY

An object of the present invention is therefore to provide an electronic component and a manufacturing method thereof capable of reducing a variation in height of the top surface between the conductor patterns in each conductor layer in a lamination process of the conductor patterns.

To solve the above problem, an electronic component according to the present invention includes: a first conductor layer including a first conductor pattern; a first insulating layer covering the first conductor layer, the first insulating layer having a first opening passing therethrough to expose top and side surfaces of the first conductor pattern; and a second conductor layer formed on the first insulating layer and including a second conductor pattern in contact with the top and side surfaces of the first conductor pattern. The first opening surrounds a first opening region in a planar view, the first opening region including a first region in which the first conductor pattern is formed and a second region free from the first conductor pattern. The second conductor pattern is embedded in both the first and second regions of the first opening region.

According to the present invention, the first conductor pattern is formed in such a manner that the first opening region has a concave (or convex) pattern corresponding to a final convex (or concave) shape thereof, and the second conductor pattern is formed on the first conductor pattern, so that the concave (or convex) shape in the lower layer and convex (or concave) shape in the upper layer can be canceled each other to reduce a variation in height between the conductor patterns in each conductor layer and thus to make the top surface of the second conductor pattern as flat as possible. Further, the conductor pattern in the upper layer can be connected to the side surface of the conductor pattern in the lower layer, so that joint strength between the first and second conductor patterns can be enhanced.

In the present invention, it is preferable that the first region is positioned at a region obtained from the first opening region by excluding at least a center portion of the first opening region, and the second region is positioned at a region obtained by excluding the first region from the first opening region. In this case, it is preferable that the first conductor pattern is a closed loop pattern or a U-shape pattern and that the second region includes a region inside the closed loop pattern or U-shape pattern. When a conductor formation area is slightly large, a center portion of the top surface of the conductor pattern in the topmost layer is likely to bulge. However, when the first conductor pattern is formed into the shape as described above, the concave shape in the lower layer and convex shape in the upper layer can be canceled each other to reduce a variation in height between the conductor patterns in each conductor layer and thus to make the top surface of the conductor pattern in the upper layer as flat as possible.

In the present invention, it is preferable that the second region is positioned at a region obtained from the first opening region by excluding at least a center portion of the first opening region, and the first region is positioned at a region obtained by excluding the second region from the first opening region. In this case, it is preferable that the first conductor pattern is an island shaped pattern and that the second region includes a surrounding region of the island shaped pattern. When a conductor formation area is significantly large, an outer peripheral portion of the top surface of the conductor pattern in the upper layer is likely to bulge, while the center portion thereof is likely to sag. However, when the first conductor pattern is formed into the shape as described above, the convex shape in the lower layer and concave shape in the upper layer can be canceled each other to reduce a variation in height between the conductor patterns in each conductor layer and thus to make the top surface of the conductor pattern in the upper layer as flat as possible.

The first conductor layer preferably further includes a planar coil pattern. In this case, it is particularly preferable that the planar coil pattern is a spiral conductor and that the first conductor pattern is connected to an inner peripheral or outer peripheral end of the spiral conductor. When a thickness of the planar coil pattern, such as the spiral conductor, needs to be increased in order to reduce DC resistance, the concave or convex shape of the first conductor pattern formed on the same plane on which the planar conductor pattern is formed is further emphasized, with the result that concave or convex shape of the second conductor pattern in a layer formed on the first conductor pattern becomes more noticeable. However, when the first conductor pattern is formed into the shape as described above, the concave shape in the lower layer and convex shape in the upper layer can be canceled each other to thereby make the top surface of the conductor pattern in the upper layer as flat as possible.

It is preferable that the electronic component according to the present invention further includes: a second insulating layer covering the second conductor layer, the second insulating layer having a second opening passing therethrough to expose top and side surfaces of the second conductor pattern; and a third conductor pattern formed on the second insulating layer so as to be in contact with both the top and side surfaces of the second conductor pattern. The second opening surrounds a second opening region in the planar view, the second opening region including a third region which has a portion overlapping with the first region in the planar view and in which the second conductor pattern is formed, and a fourth region free from the second conductor pattern. The third region has a size different from the first region, and the third conductor pattern is embedded in both the third and fourth regions of the second opening region. In a three-layer structure, the concave or convex shape of the conductor pattern in the topmost layer is more noticeable; however, in the present invention, the concave (or convex) shape in the lower layer and convex (or concave) pattern in the upper layer can be canceled each other to make the top surface of the third conductor pattern as flat as possible. Further, the conductor pattern in the upper layer can be connected to the side surface of the conductor pattern in the lower layer, so that the joint strength between the conductor patterns in the upper and lower layers can be enhanced.

In the present invention, it is preferable that the first conductor layer further includes a first spiral conductor, and that the second conductor layer further includes a second spiral conductor magnetically coupled to the first spiral conductor. With this configuration, it is possible to reduce a variation in height of the conductor pattern and to enhance connection reliability in a common mode filter having a laminated structure of the two spiral conductors.

A manufacturing method of an electronic component according to the present invention includes a step of forming a first conductor layer including a first conductor pattern, a step of forming a first insulating layer covering the first conductor layer, a step of forming a first opening in the first insulating layer so that upper and side surfaces of the first conductor pattern are exposed through the first opening, and a step of forming, on the first insulating layer, a second conductor layer including a second conductor pattern and connecting, through the first opening, the second conductor pattern to the first conductor pattern. The first opening surrounds a first opening region in a planar view, the first opening region including a first region in which the first conductor pattern is formed and a second region free from the first conductor pattern. The second conductor pattern is embedded in both the first and second regions of the first opening region.

According to the present invention, the first conductor pattern is formed in such a manner that the first opening region has a concave (or convex) pattern corresponding to a final convex (or concave) shape thereof, and the second conductor pattern is formed on the first conductor pattern, so that the concave (or convex) shape in the lower layer and convex (or concave) shape in the upper layer can be canceled each other to thereby make the top surface of the second conductor pattern as flat as possible. Further, the conductor pattern in the upper layer can be connected to the side surface of the conductor pattern in the lower layer, so that joint strength between the first and second conductor patterns can be enhanced.

In the present invention, the first conductor layer formation step preferably includes a step of forming a planar coil pattern in addition to the first conductor pattern. When a thickness of the planar coil pattern, such as the spiral conductor, needs to be increased in order to reduce DC resistance, the concave or convex shape of the first conductor pattern formed on the same plane as that on which the planar conductor pattern is formed is further emphasized, with the result that concave or convex shape of the second conductor pattern in a layer formed on the first conductor pattern becomes more noticeable. However, when the first conductor pattern is formed into the shape as described above, the concave shape in the lower layer and convex shape in the upper layer can be canceled each other to reduce a variation in height between the conductor patterns in each conductor layer and thus to make the top surface of the conductor pattern as flat as possible.

According to the present invention, it is possible to provide an electronic component and a manufacturing method thereof capable of preventing the top surface of the conductor pattern in the topmost layer from bulging or sagging in a lamination process of the conductor pattern and making the same as flat as possible.

BRIEF DESCRIPTION OF THE DRAWINGS

The above features and advantages of the present invention will be more apparent from the following description of certain preferred embodiments taken in conjunction with the accompanying drawings, in which:

FIGS. 4A to 4C are schematic views showing a two-layer laminated structure of the conductor pattern for preventing the bulge in the topmost layer, wherein FIG. 4A is a plan view showing a planar shape of the conductor pattern in a lower layer (first layer), FIG. 4B is a plan view showing a planar shape of the conductor pattern in an upper layer (second layer), and FIG. 4C is a cross-sectional view taken along X1-X1' lines of FIGS. 4A and 4B;

FIGS. 7A to 7C are schematic views showing a two-layer laminated structure of the conductor pattern for preventing the sag in the topmost layer, wherein FIG. 7A is a plan view showing a planar shape of the conductor pattern in a lower layer (first layer), FIG. 7B is a plan view showing a planar shape of the conductor pattern in an upper layer (second layer), and FIG. 7C is a cross-sectional view taken along X1-X1' lines of FIGS. 7A and 7B;

DETAILED DESCRIPTION OF THE EMBODIMENTS

Preferred embodiments of the present invention will be explained below in detail with reference to the accompanying drawings.

Figure 1:
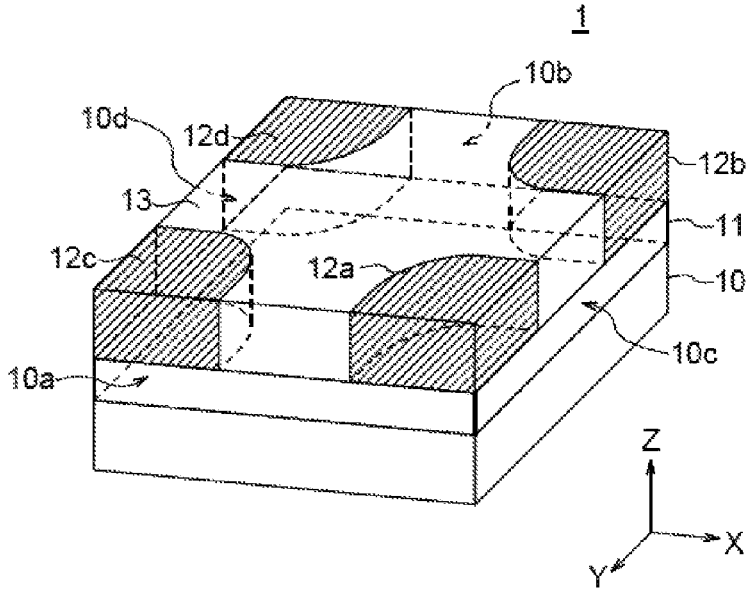
FIG. 1 is a schematic perspective view showing a structure of a coil component 1 that is an electronic component according to a first embodiment of the present invention.

FIG. 1 is a schematic perspective view showing a structure of a coil component 1 that is an electronic component according to a first embodiment of the present invention.

As shown in FIG. 1, a coil component 1 according to the present embodiment is a common mode filter and includes a substrate 10, a thin-film coil layer 11 including a common mode filter element provided on one main (top) surface of the substrate 10, first to fourth bump electrodes 12*a* to 12*d* provided on one main (top) surface of the thin-film coil layer 11, and a magnetic resin layer 13 provided on the main surface of the thin-film coil layer 11 excluding formation positions of the bump electrodes 12*a* to 12*d*.

The coil component 1 is a surface mount chip component having a substantially rectangular parallelepiped shape. The coil component 1 has two side surfaces 10*a*, 10*b* extending in parallel to a longitudinal direction (X-direction) and two surfaces 10*c*, 10*d* extending perpendicular to the longitudinal direction. The first to fourth bump electrodes 12*a* to 12*d* are provided at corner portions of the coil component 1 so as to each have an exposed surface at an outer peripheral surface of the coil component 1. More specifically, the first bump electrode 12*a* has exposed surfaces at the side surfaces 10*a* and 10*c*, respectively, the second bump electrode 12*b* has exposed surfaces at the side surfaces 10*b* and 10*c*, respectively, the third bump electrode 12*c* has exposed surfaces at the side surfaces 10*a* and 10*d*, respectively, and the fourth bump electrode 12*d* has exposed surfaces at the side surfaces 10*b* and 10*d*, respectively. Ina mounting state, the coil component 1 is turned upside down and used with the bump electrodes 12*a* to 12*d* facing down.

The substrate 10 ensures mechanical strength of the coil component 1 and serves as a closed magnetic path of the common mode filter. A magnetic ceramic material, for example, sintered ferrite can be used as a material of the substrate 10. Further, depending on required characteristics, a non-magnetic material may be used. Though not particularly limited, when a chip size is a "0605" type (0.6×0.5×0.5 (mm)), a thickness of the substrate 10 can be set to about 0.1 mm to 0.3 mm.

The thin-film coil layer 11 is a layer including a common mode filter element provided between the substrate 10 and magnetic resin layer 13. The thin-film coil layer 11 has, as will be described in detail later, a multi-layered structure formed by an insulating layer and a conductor pattern being alternately stacked. Thus, the coil component 1 according to the present embodiment is so-called a thin-film type coil component and is to be distinguished from a wire wound type having a structure in which a conductor wire is wound around a magnetic core.

The magnetic resin layer 13 is a layer constituting a mounting surface (bottom surface) of the coil component 1 and protects the thin-film coil layer 11 together with the substrate 10 and also serves as a closed magnetic path of the coil component 1. However, mechanical strength of the magnetic resin layer 13 is weaker than that of the substrate 10 and plays only a supplementary role in terms of strength. An epoxy resin (composite ferrite) containing mainly ferrite powder can be used as the magnetic resin layer 13. Though not particularly limited, when the chip size is the "0605" type, a thickness of the magnetic resin layer 13 can be set to about 0.02 mm to 0.1 mm.

Figure 2:
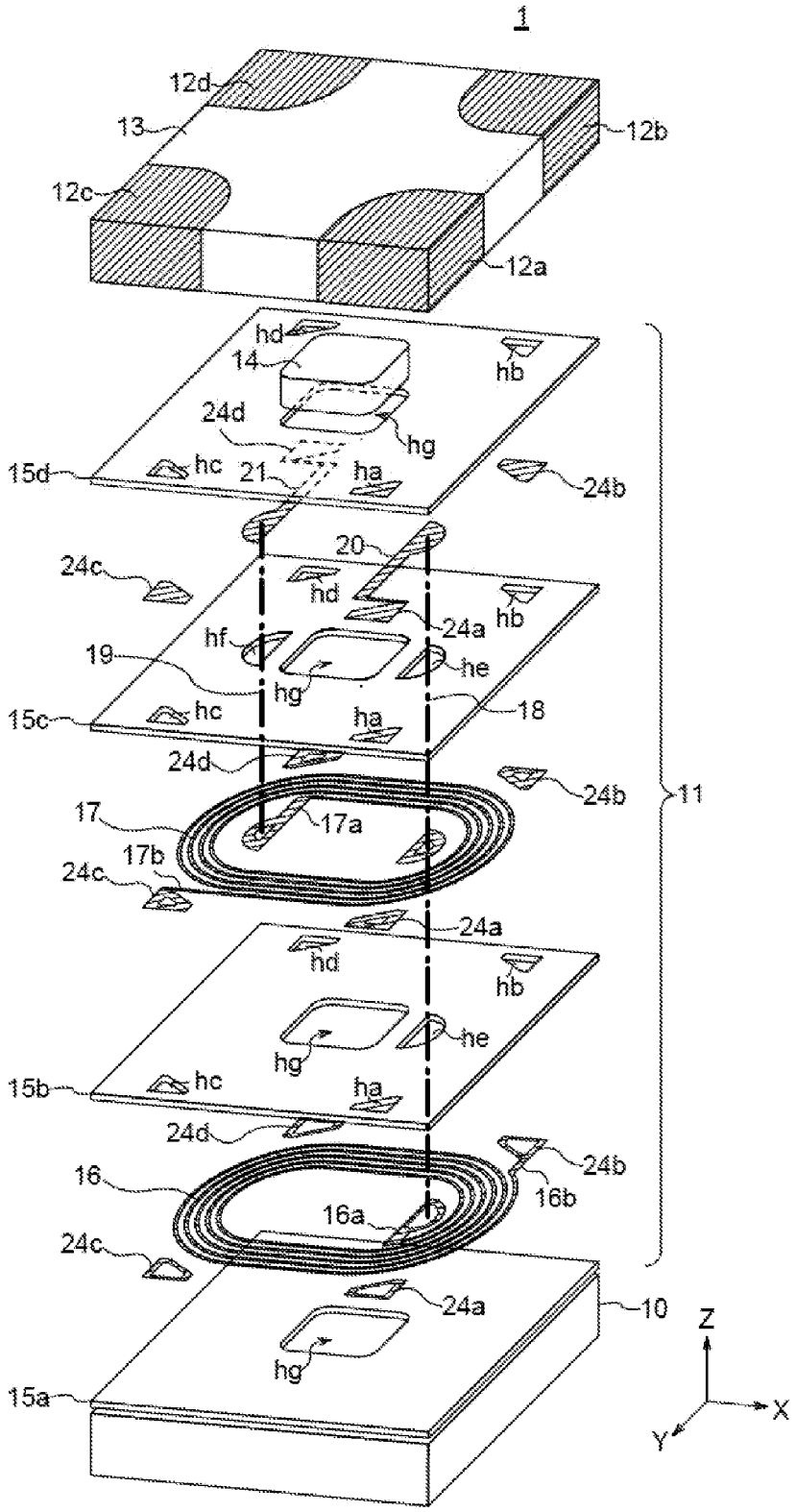
FIG. 2 is a schematic exploded perspective view showing a layer structure of the coil component 1 in detail.
Figure 3:
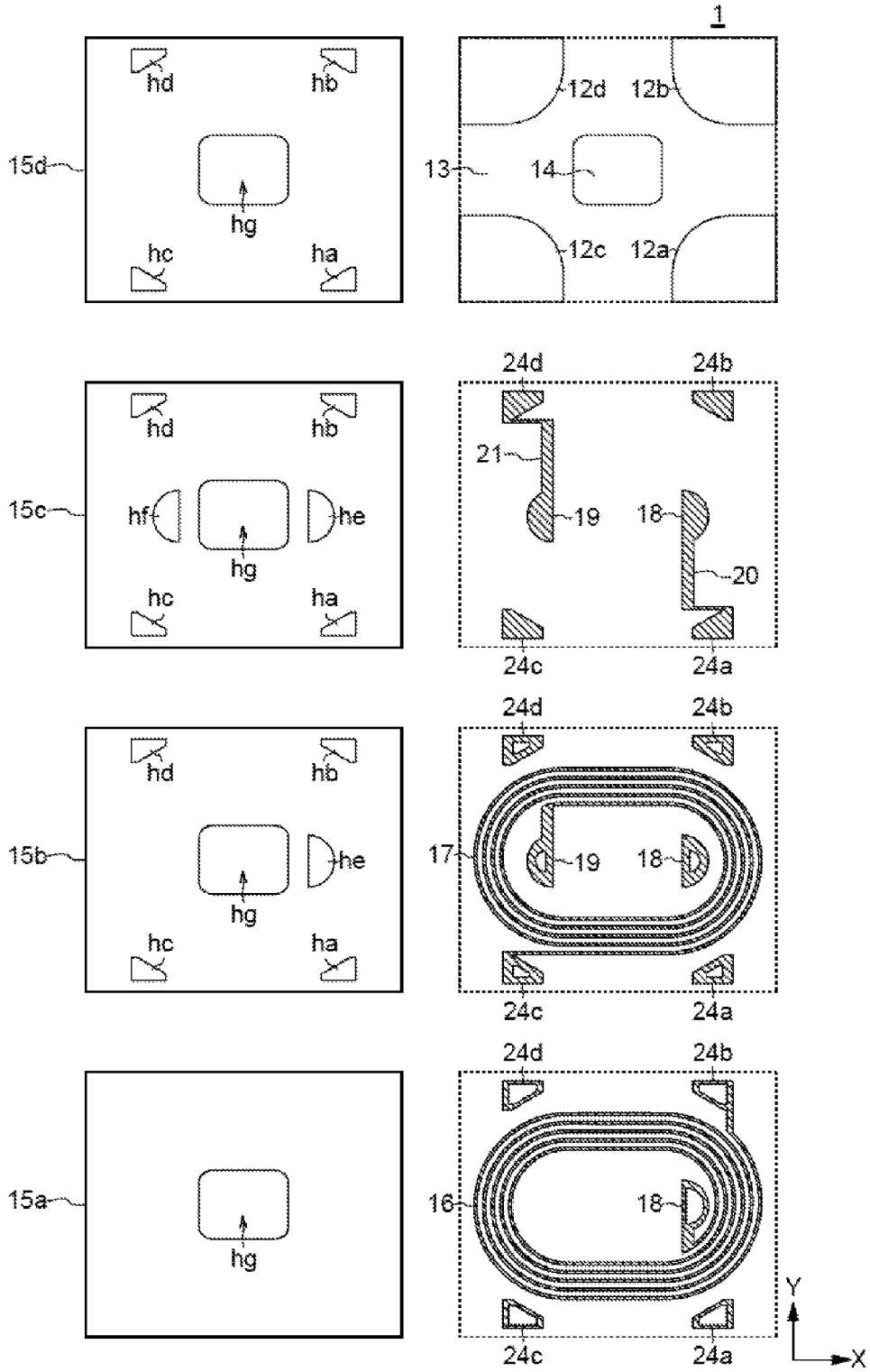
FIG. 3 is a plan view showing each resolved layer.

FIG. 2 is a schematic exploded perspective view showing a layer structure of the coil component 1 in detail. Further, FIG. 3 is a plan view showing each resolved layer.

As shown in FIG. 2, the thin-film coil layer 11 includes first to fourth insulating layers 15*a* to 15*d*, and first to third conductor layers. The first to fourth insulating layers 15*a* to 15*d* are sequentially stacked from the substrate 10 side toward the magnetic resin layer 13 side. The first conductor layer includes a first spiral conductor 16 as a planar coil pattern formed on the first insulating layer 15*a* and internal terminal electrodes 24*a* to 24*d*. The second conductor layer includes a second spiral conductor 17 as a planar coil pattern formed on the second insulating layer 15*b* and the internal terminal electrodes 24*a* to 24*d*. The third conductor layer includes first and second lead conductors 20 and 21 formed on the third insulating layer 15*c* and internal terminal electrodes 24*a* to 24*d*. Bump electrodes 12*a* to 12*d* are provided on the fourth insulating layer 15*d*. A conductor pattern such as the internal terminal electrode is not formed on the fourth insulating layer 15*d*.

The first to fourth insulating layers 15*a* to 15*d* insulate the conductor patterns provided in different layers and also serve to secure flatness of the plane on which the conductor patterns are formed. Particularly, the first insulating layer 15*a* serves to increase accuracy of finishing the spiral conductor patterns by absorbing unevenness of the surface of the substrate 10. It is preferable to use a resin excellent in electric and magnetic insulation properties and easy in microfabrication as a material of the insulating layers 15*a* to 15*d* and though not particularly limited, a polyimide resin or epoxy resin can be used.

An internal peripheral end 16*a* of the first spiral conductor 16 is connected to the first bump electrode 12*a* through a first contact hole conductor 18 passing through the second and third insulating layers 15*b*, 15*c*, first lead conductor 20, and first internal terminal electrode 24*a*. An external peripheral end 16*b* of the first spiral conductor 16 is connected to the second bump electrode 12*b* through the second internal terminal electrode 24*b*.

An internal peripheral end 17*a* of the second spiral conductor 17 is connected to the fourth bump electrode 12*d* through a second contact hole conductor 19 passing through the third insulating layer 15*c*, second lead conductor 21, and fourth internal terminal electrode 24*d*. An external peripheral end 17*b* of the second spiral conductor 17 is connected to the third bump electrode 12*c* through the third internal terminal electrode 24*c*.

The first and the second spiral conductors 16 and 17 have substantially the same plane shape and are provided in the same position in a plan view. The first and the second spiral conductors 16 and 17 overlap each other and thus, strong magnetic coupling is generated between both conductors. The first spiral conductor 16 is wound counterclockwise from the inner peripheral end 16*a* toward outer peripheral end 16*b*, and the second spiral conductor 17 is wound counterclockwise from the outer peripheral end 17*b* toward inner peripheral end 17*a*, so that a direction of a magnetic flux generated by current flowing from the first bump electrode 12*a* toward the second bump electrode 12*b* and a direction of a magnetic flux generated by current flowing from the third bump electrode 12*c* toward the fourth bump electrode 12*d* become the same, enhancing the entire magnetic flux. With the above configuration, the conductor patterns in the thin-film coil layer 11 constitute a common mode filter.

The first and the second spiral conductors 16 and 17 have both a circular spiral outer shape. A circular spiral conductor attenuates less at high frequencies and thus can be used preferably as a high-frequency inductance. The spiral conductors 16 and 17 according to the present embodiment have an oblong shape, but may also have a complete round shape or elliptic shape. Alternatively, the spiral conductors 16 and 17 may have a substantially rectangular shape.

It is preferable that the first and second spiral conductors 16 and 17 each have a certain amount of thickness in order to reduce the DC resistance thereof. It is preferable that the aspect ratio (height/width) of the cross section of each spiral conductor is one or more.

An opening hg passing through the first to fourth insulating layers 15*a* to 15*d* is provided in a central region of each of the first to fourth insulating layers 15*a* to 15*d* and on an inner side of each of the first and second spiral conductors 16 and 17, and a through-hole magnetic body 14 for forming a magnetic path is formed inside the opening hg. It is preferable to use the same material as that of the magnetic resin layer 13 as a material of the through-hole magnetic body 14.

The first and second lead conductors 20 and 21 are formed on the surface of the third insulating layer 15*c*. One end of the first lead conductor 20 is connected to an upper end of the contact hole conductor 18, and the other end thereof is connected to the internal terminal electrode 24*a*. Further, one end of the second lead conductor 21 is connected to an upper end of the contact hole conductor 19, and the other end thereof is connected to the internal terminal electrode 24*d*.

The first to fourth bump electrodes 12*a* to 12*d* are provided on the fourth insulating layer 15*d* constituting a surface layer of the thin-film coil layer 11. The first to fourth bump electrodes 12*a* to 12*d* are external terminal electrodes and are connected to the internal terminal electrodes 24*a* to 24*d*, respectively. The "bump electrode" herein means not an electrode formed by thermally compressing a metal ball of Cu, Au or the like using a flip chip bonder but a thick-film plated electrode formed by plating. A thickness of the bump electrode is equal to or more than the thickness of the magnetic resin layer 13 and can be set to about 0.02 mm to 0.1 mm. That is, the thickness of each of the bump electrodes 12*a* to 12*d* is larger than a conductor pattern in the thin-film coil layer 11 and particularly has a thickness five times or more than the spiral conductor pattern in the thin-film coil layer 11.

The first to fourth bump electrodes 12*a* to 12*d* have substantially the same plane shape. According to the configuration, the bump electrode pattern in the bottom surface of the coil component 1 has symmetric property and thus, a terminal electrode pattern that is free from constrained mounting orientation and good-looking can be provided.

The magnetic resin layer 13 is formed, together with the first to fourth bump electrodes 12*a* to 12*d*, on the fourth insulating layer 15*d*. The magnetic resin layer 13 is provided so as to fill peripheries of the bump electrodes 12*a* to 12*d*. A side surface of each of the bump electrodes 12*a* to 12*d* contacting the magnetic resin layer 13 preferably has a curved shape without edges (corners). The magnetic resin layer 13 is formed by pouring a paste of composite ferrite after the bump electrodes 12*a* to 12*d* are formed, and if, at this point, the side surface of each of the bump electrodes 12*a* to 12*d* has an edge portion, surroundings of the bump electrodes are not completely packed with the paste and bubbles are more likely to be contained. However, if the side faces of the bump electrodes 12*a* to 12*d* are curved, fluid resin reaches every corner so that a closely packed magnetic resin layer 13 containing no bubbles can be formed. Moreover, adhesiveness between the magnetic resin layer 13 and the bump electrodes 12*a* to 12*d* is increased so that reinforcement for the bump electrodes 12*a* to 12*d* can be increased.

The second insulating layer 15*b* has, formed therein, openings ha to hd corresponding respectively to the first to fourth internal terminal electrodes 24*a* to 24*d* and an opening he corresponding to the first contact hole conductor 18. The openings ha to he are provided for ensuring electrical connection between the upper and lower conductor layers. The internal terminal electrodes 24*a* to 24*d* formed on the second insulating layer 15*b* are partly embedded in the openings ha to hd of the second insulating layer 15*b* provided just therebelow (see FIG. 4C) to be electrically connected to the internal terminal electrodes 24*a* to 24*d* formed on the first insulating layer 15*a*. Note that the openings ha to hd corresponding to the internal terminal electrodes are not formed in the first insulating layer 15*a*.

The third insulating layer 15*c* has, formed therein, an opening hf corresponding to the second contact hole conductor 19, in addition to the openings ha to he. The internal terminal electrodes 24*a* to 24*d* formed on the third insulating layer 15*c* are partly embedded in the openings ha to hd of the third insulating layer 15*c* provided just therebelow (see FIG. 4C) to be electrically connected to the internal terminal electrodes 24*a* to 24*d* formed on the second insulating layer 15*b*.

The fourth insulating layer 15*d* has, formed therein, the openings ha to hd but does not have the openings he and hf corresponding respectively to the first and second contact hole conductors 18 and 19. The bump electrodes 12*a* to 12*d* are partly embedded in the openings ha to hd of the fourth insulating layer 15*d*. Thus the bump electrodes 12*a* to 12*d* are respectively connected to top surfaces of the internal terminal electrodes 24*a* to 24*d* on the third insulating layer 15*c* through the openings ha to hd formed in the fourth insulating layer 15*d*.

As shown in FIG. 3, the contact hole conductors 18, 19 and internal terminal electrodes 24*a* to 24*d* formed on the third insulating layer 15*c* are each formed all over a desired formation region thereof; while the contact hole conductors 18, 19 and internal terminal electrodes 24*a* to 24*d* formed on the second insulating layer 15*b* are each formed into a doughnut (loop) shape in which a conductor in the center is eliminated. Further, the contact hole conductors 18, 19 and internal terminal electrodes 24*a* to 24*d* formed on the first insulating layer 15*a* located below the second insulating layer 15*b* are each formed so that a width of a loop-shaped conductor is small (area of a center portion in which no conductor is formed is large).

The contact hole conductors 18, 19 and internal terminal electrodes 24*a* to 24*d* are each a conductor pattern having a comparatively large area and thus plating thereon is likely to grow up excessively at its center portion. Thus, when such a conductor pattern is formed all over a desired formation region thereof in all the conductor layers from the lowermost to topmost layers, an increase in thickness of the conductor pattern is emphasized to easily cause a bulge on a top surface of the conductor pattern on the topmost layer. Particularly, when a thickness (aspect ratio) of each of the spiral conductors 16 and 17 needs to be increased in order to reduce DC resistance, a thickness of each of the contact hole conductors 18, 19 and the internal terminal electrodes 24*a* to 24*d* that are formed simultaneously with the spiral conductors 16 and 17 are increased, so that an in-plane variation in the thickness is likely to increase. That is, the bulge on the top surface of the conductor pattern in the topmost layer becomes noticeable. However, in the present invention, a cavity portion is formed at a center portion in the planar direction of each of the conductor patterns in the layers below the topmost layer, and a plane size (area) of the cavity portion (the center portion in which no conductor is formed) is made gradually smaller toward the upper layer, with the result that flatness of the top surface of the conductor pattern in the topmost layer can be enhanced.

A laminated structure of the conductor pattern for preventing the bulge in the topmost layer will be described in detail below.

Figure 4A:
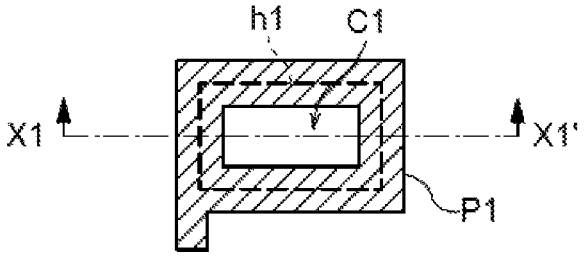
Figure 4B:
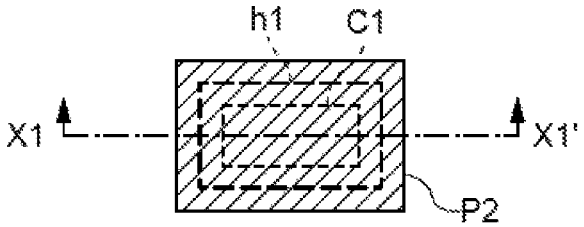
Figure 4C:
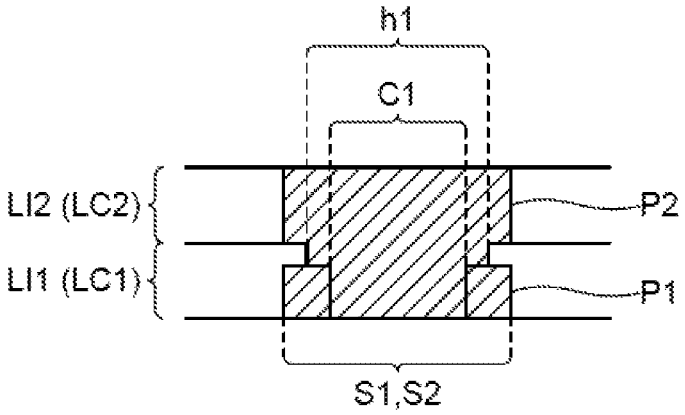

FIGS. 4A to 4C are schematic views showing a two-layer laminated structure of the conductor pattern for preventing the bulge in the topmost layer. FIG. 4A shows a planar shape of the conductor pattern in a lower layer (first layer) and FIG. 4B shows a planar shape of the conductor pattern in an upper layer (second layer). FIG. 4C is a cross-sectional view taken along X1-X1' lines of FIGS. 4A and 4B. In the following examples, it is assumed that the conductor pattern has a rectangular shape. However, the planar shape of the conductor pattern is not limited to this but may be varied to an arbitrary shape, like the contact hole conductors 18, 19 and internal terminal electrodes 24*a* to 24*d* shown in FIGS. 2 and 3, according to function or arrangement thereof.

As shown in FIGS. 4A to 4C, a conductor pattern P1 (first conductor pattern) in a lower layer (first conductor layer LC1) is formed within a predetermined conductor formation region S1 and has a doughnut shape (closed loop shape) in a plan view having a cavity portion C1 at a center thereof. A periphery of the conductor pattern P1 is covered by an insulating layer LI1, and a part of the conductor pattern P1 and cavity portion C1 are exposed through an opening h1 (first opening) passing through the insulating layer LI1.

In FIG. 4A, a planar region (first opening region) inside the opening h1 denoted by a dashed line includes a region (first region) in which a hatched conductor pattern P1 is formed and a region (second region) in which the conductor pattern is not formed. The first region is a region obtained by excluding the center cavity portion C1 from the first opening region, and the second region is a region obtained by excluding the first region from the first opening region, i.e., the cavity portion C1.

A conductor pattern P2 (second conductor pattern) in an upper layer (second conductor layer LC2) overlapped on the conductor pattern P1 in the lower layer is formed all over a conductor formation region S2 thereof so as to cover the entire surface of the conductor pattern P1 in a plan view. A part of the conductor pattern P2 is also embedded inside the center cavity portion C1 of the conductor pattern P1. That is, the conductor pattern P2 is embedded both in the first and second regions of the opening h1. An insulating layer LI2 is filled around the conductor pattern P2.

Figure 12A:
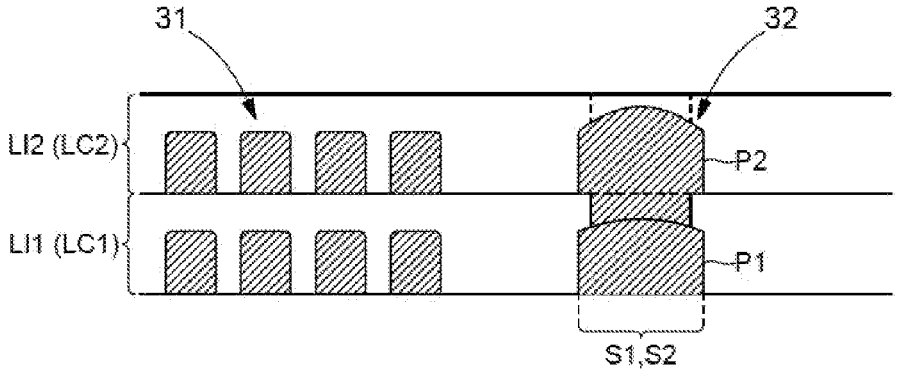
FIGS. 12A and 12B are schematic cross-sectional views showing a laminated structure of conductor patterns according to a related art.

As shown in FIG. 12A, when the conductor pattern in each conductor layer is formed all over the formation region thereof, a bulge is likely to occur due to concentration of plating current, and the bulge becomes more emphasized toward the upper layer. However, in the present invention, as shown in FIGS. 4A to 4C, the cavity portion C1 is formed at the center of the conductor pattern P1 in the lower layer to allow the center of the conductor pattern P1 to sag, so that the sag in the lower layer and bulge in the upper layer cancel each other, thereby allowing the top surface of the conductor pattern P2 in the upper layer to be made substantially flat.

In forming the layered structure shown in FIGS. 4A to 4C, first the conductor pattern P1 is formed in the first conductor formation region S1, then the insulating layer LI1 is formed on the conductor pattern P1, and the opening h1 is formed in the insulating layer LI1 to expose the conductor pattern therethrough. At this point, both the top and side surfaces of the conductor pattern P1 are exposed through the opening h1. Then, the conductor pattern P2 is formed in the second conductor formation region S2 overlapping, in a plan view, with the first conductor formation region S1 on the top surface of the insulating layer LI1. The conductor pattern P2 is formed so as to cover the entire surface of the conductor pattern P1 in a plan view, whereby the first and second conductor patterns P1 and P2 are connected to each other.

Figure 5:
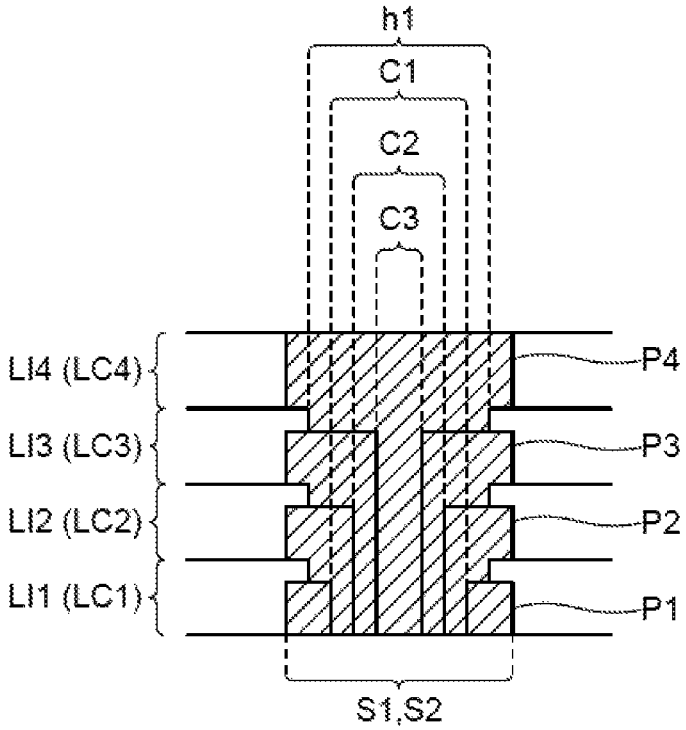
FIG. 5 is a schematic cross-sectional view showing a four-layer laminated structure of the conductor pattern for preventing the bulge in the topmost layer.

FIG. 5 is a schematic cross-sectional view showing a four-layer laminated structure of the conductor pattern for preventing the bulge in the topmost layer.

As shown in FIG. 5, when the number of layered conductor patterns is increased, the areas of the cavity portions of the conductor patterns should be gradually reduced toward the upper layer. That is, the conductor patterns P1 to P3 in the respective first to third layers each have a doughnut shape having the cavity portion (C1 to C3) at a center thereof, in which a size of the cavity portion C2 of the conductor pattern P2 in the second layer is smaller than that of the cavity portion C1 of the conductor pattern P1 in the first layer, and a size of the cavity portion C3 of the conductor pattern P3 in the third layer is smaller than that of the cavity portion C2 of the conductor pattern P2 in the second layer. A conductor pattern P4 in the topmost (fourth) layer is formed all over a formation region S4 thereof, and a part of the conductor pattern P4 is embedded in the cavity portion C3 of the conductor pattern P3. Thus, when the number of layered conductor patterns is increased, the intentionally generated sag in the lower layer is gradually made flat toward the upper layer, thereby allowing the top surface of the conductor pattern in the topmost layer to be made substantially flat.

FIGS. 6A to 6F are schematic plan views each showing a modification of a planar layout of the conductor pattern in the lower layer shown in FIGS. 4A to 4C.

Figure 6A:
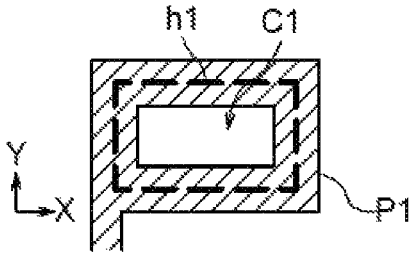
FIGS. 6A to 6F are schematic plan views each showing a modification of a planar layout of the conductor pattern in the lower layer shown in FIGS. 4A to 4C.
Figure 6B:
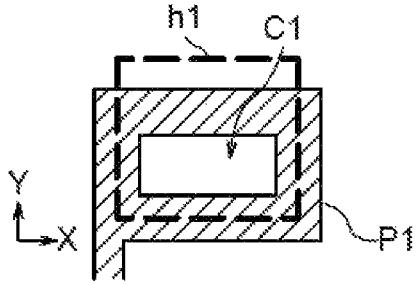

Each of examples of the conductor pattern P1 in the lower layer shown in FIGS. 6A and 6B is a closed loop pattern having the cavity portion C1 at a center of a rectangular pattern, as in the conductor pattern P1 of FIG. 4A. In the example of FIG. 6A, the opening h1 of the insulating layer LI1 formed on the conductor pattern P1 does not run over an outer periphery of the conductor pattern P1 but located therewithin. In the example of FIG. 6B, the opening h1 of the insulating layer LI1 formed on the conductor pattern P1 runs over the outer periphery of the conductor pattern P1. A direction in which the opening h1 runs over is a direction (Y-direction) orthogonal to a longitudinal direction (X-direction) of the conductor pattern P1.

Figure 6C:
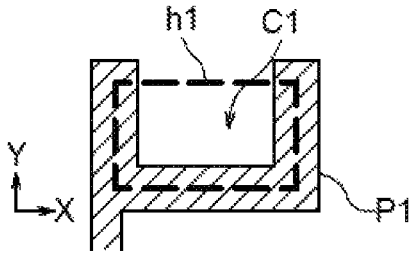
Figure 6D:
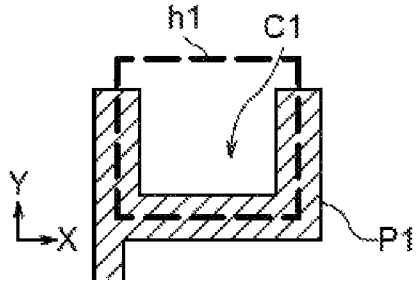

Each of examples of the conductor pattern P1 shown in FIGS. 6C and 6D is substantially a U-shape pattern obtained by cutting a side of a rectangular pattern parallel to a longitudinal direction thereof. This U-shape pattern can be regarded as a pattern having the cavity portion C1 at the center of the rectangular pattern. In the example of FIG. 6C, the opening h1 of the insulating layer LI1 formed on the conductor pattern P1 is located within the outer periphery of the conductor patter P1. In the example of FIG. 6D, the opening h1 of the insulating layer LI1 formed on the conductor pattern P1 runs over the outer periphery of the conductor pattern P1. A direction in which the opening h1 runs over is a direction (Y-direction) of the cut portion of the conductor pattern P1.

Figure 6E:
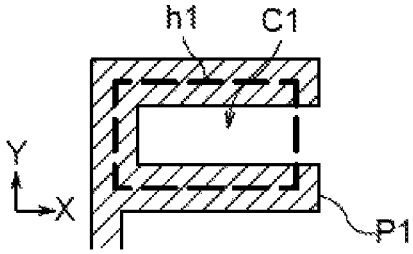
Figure 6F:
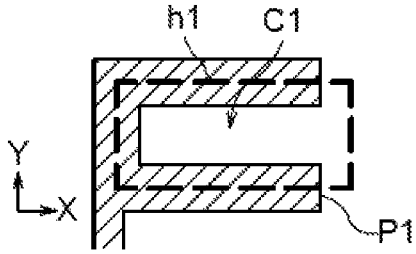

Each of examples of the conductor pattern P1 shown in FIGS. 6E and 6F is substantially a U-shape pattern obtained by cutting a side of a rectangular pattern orthogonal to a longitudinal direction (X-direction) thereof. This U-shape pattern can be regarded as a pattern having the cavity portion C1 at the center of the rectangular pattern. In the example of FIG. 6E, the opening h1 of the insulating layer LI1 formed on the conductor pattern P1 is located within the outer periphery of the conductor pattern P1. In the example of FIG. 6F, the opening h1 of the insulating layer LI1 formed on the conductor pattern P1 runs over the outer periphery of the conductor pattern P1. A direction in which the opening h1 runs over is a direction (X-direction) of the cut portion of the conductor pattern P1.

In all the examples shown in FIGS. 6A to 6F, the conductor pattern in the lower layer has a shape having the cavity portion C1 at the center thereof. Thus, the bulge on the top surface of the conductor pattern in the upper layer is suppressed, even when the conductor pattern in the upper layer overlapped on the lower layer is formed all over the formation region thereof. Therefore, the top surface of the conductor pattern in the topmost layer can be made substantially flat. Further, the conductor pattern in the upper layer is brought into contact not only with the top surface of the conductor pattern but also the side surface thereof, so that joint strength between the conductor patterns of the upper and lower layers can be enhanced. Particularly, in the examples of FIGS. 6B, 6D, and 6F, the opening h1 is increased in size to expose not only an inner side surface of the conductor pattern P1 but also an outer side surface thereof, so that the joint strength between the conductor patterns of the upper and lower layers can further be enhanced.

Next, a laminated structure of the conductor pattern for preventing the sag in the topmost layer will be described in detail.

Figure 7A:
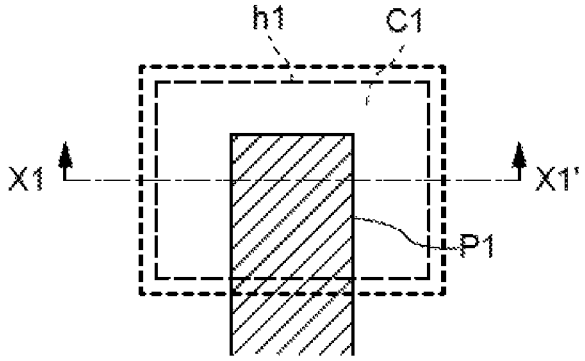
Figure 7B:
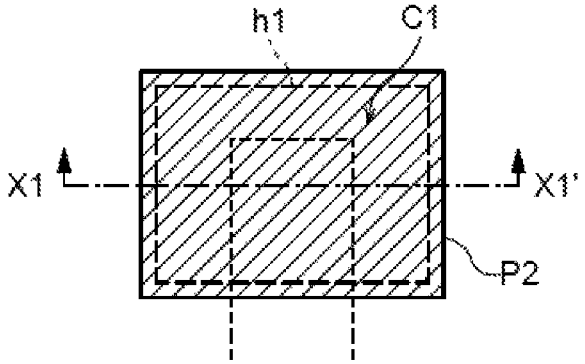
Figure 7C:
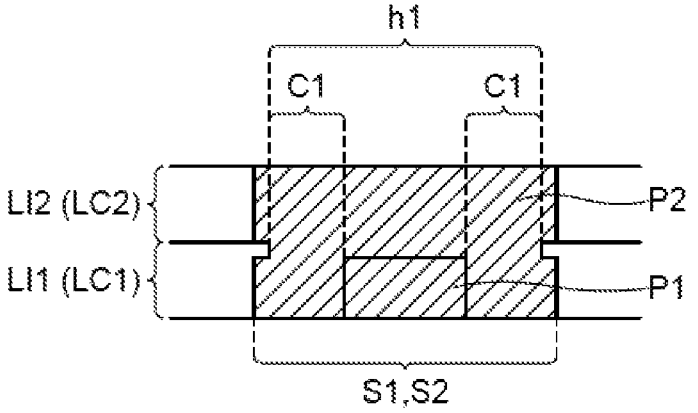

FIGS. 7A to 7C are schematic views showing a two-layer laminated structure of the conductor pattern for preventing the sag in the topmost layer. FIG. 7A shows a planar shape of the conductor pattern in a lower layer (first layer) and FIG. 7B shows a planar shape of the conductor pattern in an upper layer (second layer). FIG. 7C is a cross-sectional view taken along X1-X1' lines of FIGS. 7A and 7B. In the following examples, it is also assumed that the conductor pattern has a rectangular shape. However, the planar shape of the conductor pattern is not limited to this but may be varied to an arbitrary shape, like the contact hole conductors 18, 19 and internal terminal electrodes 24*a* to 24*d* shown in FIGS. 2 and 3, according to function or arrangement thereof.

As shown in FIGS. 7A to 7C, a conductor pattern P1 (first conductor pattern) in a lower layer (first conductor layer LC1) is formed within a predetermined conductor formation region S1 and has an island shaped pattern in a plan view formed only at substantially the center of the conductor formation region S1. This island shaped pattern is not an isolated island shaped pattern the entire periphery of which is surrounded by an insulating region, but a peninsular pattern. The island shaped pattern is drawn outward of the formation region thereof in one direction. Since the conductor pattern is formed only at the center portion of the formation region, the cavity portion C1 can be formed around the conductor pattern. A periphery of the conductor pattern P1 is covered by the insulating layer LI1 and exposed through an opening h1 (first opening) passing through the insulating layer LI1.

In FIG. 7A, a planar region (first opening region) inside the opening h1 denoted by a dashed line includes a region (first region) in which a hatched conductor pattern P1 is formed and a region (second region) in which the conductor pattern is not formed. The second region is a region obtained by excluding at least the center portion thereof from the first opening region, i.e., the cavity portion C1, and the first region is a region obtained by excluding the second region from the first opening region.

A conductor pattern P2 (second conductor pattern) in an upper layer (second conductor layer LC2) overlapped on the conductor pattern P1 in the lower layer is formed all over a conductor formation region S2 thereof so as to cover the entire surface of the conductor pattern P1 in a plan view. A part of the conductor pattern P2 is also embedded inside the cavity portion C1 around the conductor pattern P1. That is, the conductor pattern P2 is embedded both in the first and second regions of the opening h1. An insulating layer LI2 is filled around the conductor pattern P2.

Figure 12B:
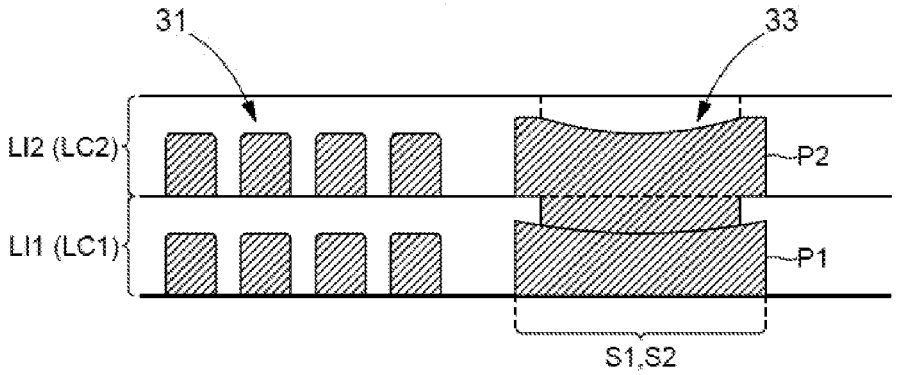

As shown in FIG. 12B, when the conductor pattern in each conductor layer is formed all over the large formation region thereof, a sag is likely to occur at the center portion thereof, and the sag becomes more emphasized toward the upper layer. However, in the present invention, as shown in FIGS. 7A to 7C, the cavity portion C1 is formed around the conductor pattern P1 in the lower layer to allow the center of the conductor pattern P1 to relatively bulge, so that the bulge in the lower layer and sag in the upper layer cancel each other, thereby allowing the top surface of the conductor pattern P2 in the upper layer to be made substantially flat.

Figure 8:
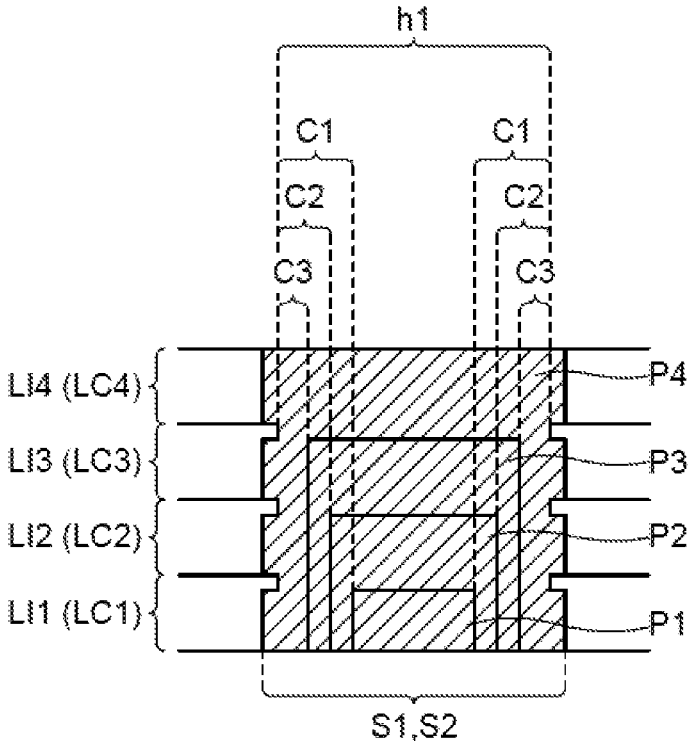
FIG. 8 is a schematic cross-sectional view showing a four-layer laminated structure of the conductor pattern for preventing the sag in the topmost layer.

FIG. 8 is a schematic cross-sectional view showing a four-layer laminated structure of the conductor pattern for preventing the sag in the topmost layer.

As shown in FIG. 8, when the number of layered conductor patterns is increased, the areas of the conductor patterns should be gradually increased toward the upper layer. That is, the conductor patterns P1 to P3 in the respective first to third layers each have a bulging shape having a planar shape only at the center thereof and having the cavity portion (C1 to C3) therearound, in which a size of the conductor pattern P2 in the second layer is larger than that of the conductor pattern P1 in the first layer, and a size of the conductor pattern P3 in the third layer is larger than that of the conductor pattern P2 in the second layer. A conductor pattern P4 in the topmost (fourth) layer is formed all over a formation region S4 thereof, and a part of the conductor pattern P4 is embedded in the cavity portion C3 around the conductor pattern P3. Thus, when the number of layered conductor patterns is increased, the intentionally generated bulge in the lower layer is gradually made flat toward the upper layer, thereby allowing the top surface of the conductor pattern in the topmost layer to be made substantially flat.

An in-plane variation in the height of the conductor pattern differs depending on a plane size of the conductor pattern. When the plane size (especially, minimum width) of the conductor pattern is slightly larger than a line width of a spiral conductor, the top surface of the conductor pattern in the topmost layer is likely to bulge at its center portion. On the other hand, when the plane size of the conductor pattern is sufficiently large, the top surface of the conductor pattern in the topmost layer is likely to sag at its center portion. When the area of the conductor pattern is excessively large, plating current tends to flow to an end portion, so that the plating is concentrated on the end portion to increase a thickness of the end portion. As a result, the end portion bulges, and the center portion relatively sags. In both cases, it is difficult to make the top surface of the conductor pattern flat in the topmost layer by only laminating the conductor patterns. Thus, in the present invention, the flatness of the conductor pattern in the topmost layer is ensured by forming the conductor pattern in the lower layer into an appropriate shape (bulge preventing pattern or sag preventing pattern) described below.

Which one to adopt between the bulge preventing pattern shown in FIGS. 4A to 4C, FIG. 5, and FIGS. 6A to 6C and the sag preventing pattern shown in FIGS. 7A to 7C and FIG. 8 can be determined based on a result obtained using a trial model produced according to a conventional method. For example, the "bulge preventing pattern (closed loop pattern or U-shape pattern)" may be adopted for a conductor pattern having a width 1.5 times to 4 times the line width of the spiral conductor, and the "sag preventing pattern" may be adopted for a conductor pattern having a width 4 times or more the line width of the spiral conductor.

The contact hole conductors 18 and 19 are formed inside the spiral conductors 16 and 17, that is, within a fairly restricted range, and when the through-hole magnetic body 14 is provided, the formation range of each of the contact hole conductors 18 and 19 is further restricted. Therefore, an area of each of the contact hole conductors 18 and 19 is comparatively small, and thus the bulge is likely to occur in the topmost layer. For this reason, the bulge preventing pattern is preferably adopted for the contact hole conductors 18 and 19.

The internal terminal electrodes 24*a* to 24*d* are provided outside the spiral conductors 16 and 17 and can thus be formed larger than the contact hole conductors 18 and 19. Further, when a common large internal terminal electrode is formed between adjacent elements in a mass-production process in which a large number of elements are formed on an aggregate substrate, an area of the internal terminal electrode is significantly increased. When the area of the internal terminal electrode is comparatively large as just described and, thus, the sag is likely to occur in the topmost layer, the sag preventing pattern is preferably adopted for the internal terminal electrodes 24*a* to 24*d*.

However, when a loop size of each of the spiral conductors 16 and 17 is increased, or when the through-hole magnetic body 14 is omitted, the contact hole conductors 18 and 19 each having a comparatively large size can be formed. Therefore, the sag preventing pattern is preferably adopted for the contact hole conductors 18 and 19. Further, when the loop size of each of the spiral conductors 16 and 17 is increased to significantly restrict the formation region of each of the internal terminal electrodes 24*a* to 24*d*, the area of each of the internal terminal electrodes 24*a* to 24*d* is reduced. In such case, the bulge preventing pattern is preferably adopted for the internal terminal electrodes 24*a* to 24*d*.

Figure 9:
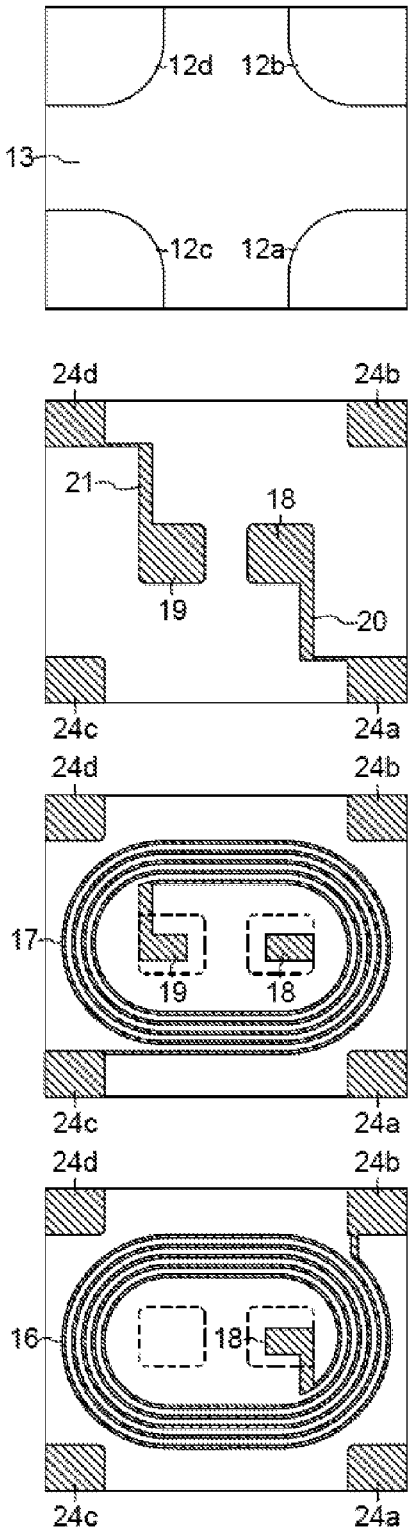
FIG. 9 is a schematic plan view showing another example of the planar layout in each conductive layer.

FIG. 9 is a schematic plan view showing another example of the planar layout in each conductive layer. As shown in FIG. 9, when the through-hole magnetic body 14 (see FIG. 3) inside the spiral conductors 16 and 17 is omitted to allow an increase in the size of each of the contact hole conductors 18 and 19, the sag preventing pattern is preferably adopted for the contact hole conductors 18 and 19.

Figure 10:
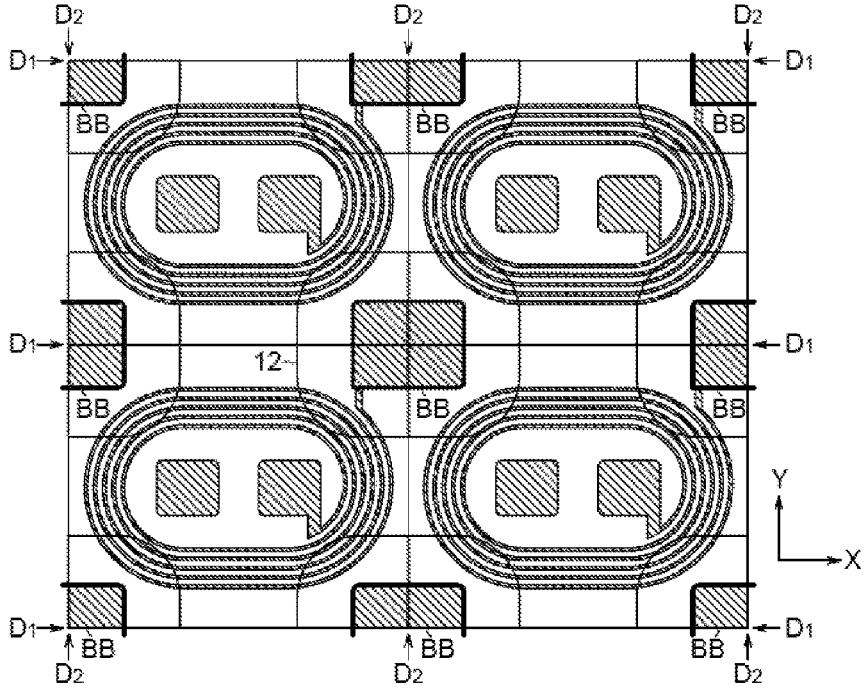
FIG. 10 is a schematic plan view showing a planar layout of an aggregate substrate.

FIG. 10 is a schematic plan view showing a planar layout of an aggregate substrate. As shown, when the internal terminal electrodes 24*a* to 24*d* are positioned at corner portions of adjacent four elements, they are formed as an integrated terminal electrode BB having a significantly large area. In this case, the sag preventing pattern is preferably adopted for the integrated terminal electrode BB.

Figure 11:
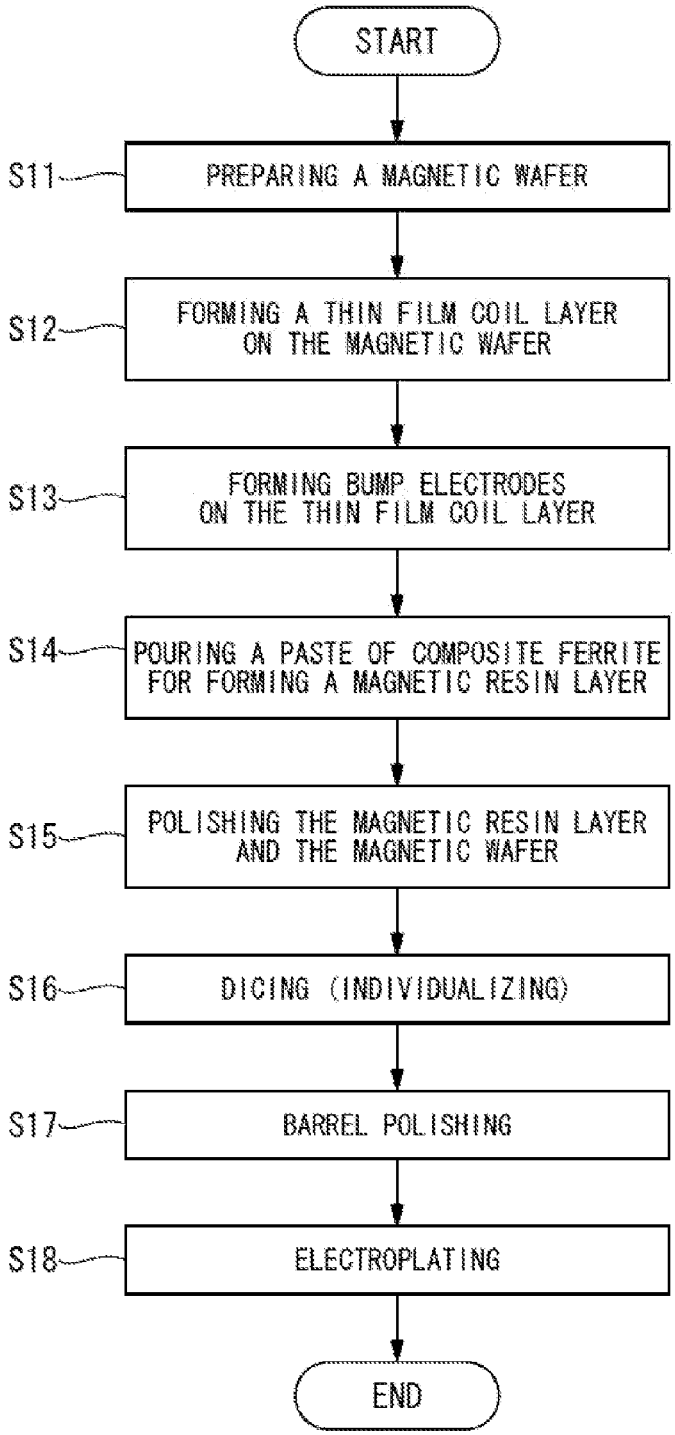
FIG. 11 is a flow chart showing a manufacturing method of the coil component 1.

FIG. 11 is a flow chart showing a manufacturing method of the coil component 1.

First a magnetic wafer is prepared (step S11) and the thin-film coil layer 11 on which a large number of common mode filter elements are laid out on the surface of the magnetic wafer is formed (step S12).

The thin-film coil layer 11 is formed by repeating a formation process of a conductor pattern on the surface of the previously formed insulating layer. The formation process of the thin-film coil layer 11 will be described in detail below.

In the formation of the thin-film coil layer 11, the insulating layer 15*a* is first formed and then, the first spiral conductor 16 and the internal terminal electrodes 24*a* to 24*d* are formed on the insulating layer 15*a*. Next, after the insulating layer 15*b* is formed on the insulating layer 15*a*, the second spiral conductor 17 and the internal terminal electrodes 24*a* to 24*d* are formed on the insulating layer 15*b*. Then, after the insulating layer 15*c* is formed on the insulating layer 15*b*, the first and second lead conductors 20, 21 and internal terminal electrodes 24*a* to 24*d* are formed on the insulating layer 15*c* and further, the insulating layer 15*d* is formed on the insulating layer 15*c* (see FIG. 2).

Each of the insulating layers 15*a* to 15*d* can be formed by spin-coating the substrate surface with a photosensitive resin or bonding a photosensitive resin film to the substrate surface and exposing and developing the resultant substrate surface. The opening hg is formed in the first insulating layer 15*a*, the openings ha to he and opening hg are formed in the second insulating layer 15*b*, the openings ha to hg are formed in the third insulating layer 15*c*, and the openings ha to hd and opening hg are formed in the fourth insulating layer 15*d*.

It is preferably to use Cu as a material of conductor patterns, which can be formed by forming a conductor layer by the vapor deposition or sputtering and then forming a patterned resist layer thereon and performing electroplating so as to remove the resist layer and unnecessary base conductor layer.

At this point, the openings (through holes) he and hf for forming the contact hole conductors 18 and 19 are each filled with a plating material, whereby the contact hole conductors 18 and 19 are formed. Further, the openings ha to hd for forming the internal terminal electrodes 24*a* to 24*d* are each also filled with the plating material, whereby the internal terminal electrodes 24*a* to 24*d* are formed.

Next, the bump electrode 12, which is an aggregation of the bump electrodes 12*a* to 12*d*, is formed on the insulating layer 15*d* as the surface layer of the thin-film coil layer 11 (step S13). As the formation method of the bump electrode 12, a base conductor layer is first formed on the entire surface of the insulting layer 15*d* by sputtering. Cu or the like can be used as a material of the base conductor layer. Then, a dry film is pasted and then the dry film in positions where the bump electrodes 12*a* to 12*d* and the first and second lead conductors 20 and 21 should be formed is selectively removed by exposure and development to form a dry film layer and to expose the base conductor layer. Note that the formation method of the bump electrode is not limited to that using the dry film.

Next, the electroplating is further performed and exposed portions of the base conductor layer are grown to form an aggregation of the thick bump electrodes 12*a* to 12*d*. At this point, the openings ha to hg formed in the insulating layer 15*d* are each filled with a plating material, whereby the bump electrodes 12*a* to 12*d* and internal terminal electrodes 24*a* to 24*d* are electrically connected, respectively.

Then, the dry film layer is removed and the unnecessary base conductor layer is removed by etching the entire surface to complete the bump electrode 12 having substantially a columnar shape. In this example, the bump electrode 12 with a substantially columnar shape is formed as an electrode common to four chip components adjacent to each other in the X- and Y-directions (see FIG. 10). However, the bump electrode 12 can be formed individually for each chip component. The bump electrode 12 is divided into four by dicing to be described later, whereby the individual bump electrodes 12*a* to 12*d* corresponding to each element are formed.

Next, a paste of composite ferrite is poured onto the magnetic wafer on which the bump electrode 12 is formed and cured to form the magnetic resin layer 13 (step S14). Further, at the same time, the paste of composite ferrite is poured also into the opening hg to form the through-hole magnetic body 14. At this time, a large amount of paste is poured to reliably form the magnetic resin layer 13, thereby the bump electrode 12 is embedded in the magnetic resin layer 13. Thus, the magnetic resin layer 13 is polished until the top surface of the bump electrode 12 is exposed to have a predetermined thickness and also to make the surface thereof smooth (step S15). Further, the magnetic wafer is also polished to have a predetermined thickness (step S15).

Thereafter, each common mode filter element is individualized (formed into a chip) by dicing of the magnetic wafer (step S16). In this case, as shown in FIG. 10, a cutting line D1 extending in the X-direction and a cutting line D2 extending in the Y-direction pass through a center of the bump electrode 12 and the obtained cut surface of each of the bump electrodes 12*a* to 12*d* is exposed to the side surface of the chipped component (chip component). The side surfaces of each of the bump electrodes 12*a* to 12*d* become a formation surface of a solder fillet during mounting and thus, fixing strength during soldering can be increased.

Next, after edges are removed by performing barrel polishing of chip components (step S17), electroplating is performed (step S18), thereby completing the bump electrodes 12*a* to 12*d* shown in FIG. 1. By performing barrel polishing of the outer surface of chip components as described above, coil components resistant to damage such as chipping can be manufactured. The surface of each of the bump electrodes 12*a* to 12*d* exposed on an outer circumferential surface of chip components is plated and thus, the surface of each of the bump electrodes 12*a* to 12*d* can be made a smooth surface.

As described above, according to the present embodiment, it is possible to easily manufacture at low cost an electronic component capable of reducing a variation in height of the top surface between the conductor patterns in each conductor layer in a lamination process of the conductor patterns. Further, the magnetic resin layer 13 is formed around the bump electrodes 12*a* to 12*d* and therefore, the bump electrodes 12*a* to 12*d* can be reinforced to prevent peeling of the bump electrodes 12*a* to 12*d* or the like. Also, according to the manufacturing method of the coil component 1 in the present embodiment, the bump electrodes 12*a* to 12*d* are formed by plating and therefore, compared with formation by, for example, sputtering, an external terminal electrode whose accuracy of finishing is higher and which is more stable can be provided. Further, reduction in cost and man-hours can be achieved.

It is apparent that the present invention is not limited to the above embodiments, but may be modified and changed without departing from the scope and spirit of the invention.

For example, although the magnetic resin layer is used to fill peripheries of the bump electrodes in the above embodiment, a simple insulating layer having no magnetic property may be used in the present invention. In addition, the through-hole magnetic body 14 may be omitted.

Further, although the thin-film coil layer 11 of a three-conductor layer structure is used in the above embodiment, the number of laminations of the conductor layer is not limited, and the structure of the thin-film coil layer 11 is not limited to the three-conductor layer structure. Further, although the common mode filter is exemplified as the coil component in the present embodiment, the present invention may be applied not only to the common mode filter, but also to various types of coil components, such as a transformer and a power supply coil. Further, the present invention may be applied not only to the coil component, but also to various electronic components in which a thin-film pattern is formed by plating.

What is claimed is:

1. An electronic component comprising:

a base insulating layer;

a first conductor layer formed on a top surface of the base insulating layer and including a first conductor pattern;

a first insulating layer covering the first conductor layer, the first insulating layer having a first opening passing therethrough to expose top and side surfaces of the first conductor pattern; and a second conductor layer formed on the first insulating layer and including a second conductor pattern in contact with the top and side surfaces of the first conductor pattern, wherein the first opening surrounds a first opening region in a planar view, the first opening region including a first region where the first conductor pattern exists and a second region where the first conductor pattern does not exist, the top surface of the base insulting layer within at least the first opening region is flat, and the second conductor pattern is embedded in both the first and second regions of the first opening region and in contact with the base insulating layer.

2. The electronic component as claimed in claim 1, wherein the first region is positioned at a region obtained from the first opening region by excluding at least a center portion of the first opening region, and the second region is positioned at a region obtained by excluding the first region from the first opening region.

3. The electronic component as claimed in claim 2, wherein the first conductor pattern is a closed loop pattern or a U-shape pattern and the second region includes a region positioned at inside the closed loop pattern or the U-shape pattern.

4. The electronic component as claimed in claim 1, wherein the second region is positioned at a region obtained from the first opening region by excluding at least a center portion of the first opening region, and the first region is positioned at a region obtained by excluding the second region from the first opening region.

5. The electronic component as claimed in claim 4, wherein the first conductor pattern is an island shaped pattern and the second region includes a region surrounding the island shaped pattern.

6. The electronic component as claimed in claim 1, wherein the first conductor layer further includes a planar coil pattern.

7. The electronic component as claimed in claim 6, wherein the planar coil pattern is a spiral conductor and the first conductor pattern is connected to an inner peripheral or outer peripheral end of the spiral conductor.

8. The electronic component as claimed in claim 1, further comprising:

a second insulating layer covering the second conductor layer, the second insulating layer having a second opening passing therethrough to expose top and side surfaces of the second conductor pattern; and a third conductor pattern formed on the second insulating layer so as to be in contact with both the top and side surfaces of the second conductor pattern, wherein the second opening surrounds a second opening region in the planar view, the second opening region including a third region which has a portion overlapping with the first region in the planar view and in which the second conductor pattern is formed, and a fourth region free from the second conductor pattern, wherein the third region has a size that is different from the first region, and the third conductor pattern is embedded in both the third and fourth regions of the second opening region.

9. The electronic component as claimed in claim 8, wherein the first conductor layer further includes a first spiral conductor, and the second conductor layer further includes a second spiral conductor magnetically coupled to the first spiral conductor.

* * * * *